US009748659B2

(12) United States Patent
Wu et al.

(10) Patent No.: US 9,748,659 B2
(45) Date of Patent: Aug. 29, 2017

(54) HIGH GAIN ANTENNA STRUCTURE

(71) Applicant: Wistron NeWeb Corp., Hsinchu (TW)

(72) Inventors: Chin-Jui Wu, Hsinchu (TW); Yu Tao, Hsinchu (TW); Jia-Fong Wu, Hsinchu (TW); Huang Tse Peng, Hsinchu (TW)

(73) Assignee: Winstron NeWeb Corp., Hsinchu (TW)

( * ) Notice: Subject to any disclaimer, the term of this patent is extended or adjusted under 35 U.S.C. 154(b) by 197 days.

(21) Appl. No.: 14/450,693

(22) Filed: Aug. 4, 2014

(65) Prior Publication Data

US 2015/0171521 A1 Jun. 18, 2015

(30) Foreign Application Priority Data

Dec. 18, 2013 (TW) ..... 102223871 A

(51) Int. Cl.

| | |
|---|---|
| ***H01Q 9/20*** | (2006.01) |
| ***H01Q 9/28*** | (2006.01) |
| ***H01Q 1/22*** | (2006.01) |
| ***H01Q 19/24*** | (2006.01) |
| ***H01Q 19/30*** | (2006.01) |
| ***H01Q 21/29*** | (2006.01) |

(52) U.S. Cl.

CPC ..... *H01Q 9/285* (2013.01); *H01Q 1/2291* (2013.01); *H01Q 19/24* (2013.01); *H01Q 19/30* (2013.01); *H01Q 21/29* (2013.01)

(58) Field of Classification Search

CPC ..... H01Q 9/20; H01Q 9/28; H01Q 9/285

See application file for complete search history.

(56) References Cited

U.S. PATENT DOCUMENTS

| | | | | |
|---|---|---|---|---|
| 2003/0122721 | A1* | 7/2003 | Sievenpiper | H01Q 9/14 343/767 |
| 2008/0165073 | A1* | 7/2008 | Chou | H01Q 9/30 343/793 |
| 2012/0088459 | A1* | 4/2012 | Neto | H01Q 1/38 455/73 |
| 2014/0125534 | A1* | 5/2014 | Ishikawa | H01Q 9/26 343/730 |

FOREIGN PATENT DOCUMENTS

| | | |
|---|---|---|
| TW | I276251 | 3/2007 |
| TW | I385861 | 2/2013 |
| TW | I408845 | 9/2013 |

* cited by examiner

*Primary Examiner* — Graham Smith
*Assistant Examiner* — Andrea Lindgren Baltzell
(74) *Attorney, Agent, or Firm* — Muncy, Geissler, Olds & Lowe, P.C.

(57) ABSTRACT

An antenna structure includes a dipole antenna element, a meandering connection line, and a cascade radiation element. The dipole antenna element includes a feeding radiation element and a grounding radiation element. The feeding radiation element has at least one open slot. The cascade radiation element is coupled through the meandering connection line to the feeding radiation element.

19 Claims, 5 Drawing Sheets

HIGH GAIN ANTENNA STRUCTURE

CROSS REFERENCE TO RELATED APPLICATIONS

This Application claims priority of Taiwan Patent Application No. 102223871 filed on Dec. 18, 2013, the entirety of which is incorporated by reference herein.

BACKGROUND OF THE INVENTION

Field of the Invention

The disclosure generally relates to an antenna structure, and more particularly to an antenna structure with high gain characteristics.

Description of the Related Art

With the progress of mobile communication technology, portable electronic devices, such as portable computers, mobile phones, tablet computers, multimedia players, and other hybrid functional mobile devices, have become more common To satisfy consumer demand, portable electronic devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

Antennas are indispensable elements in the wireless communication field. If the antenna gain of an antenna for signal reception or transmission is insufficient, the communication quality of the related mobile device will be degraded accordingly. Therefore, it is a critical challenge for antenna designers to design antenna elements with high gain characteristics.

BRIEF SUMMARY OF THE INVENTION

In one exemplary embodiment, the disclosure is directed to an antenna structure, including: a dipole antenna element, including a feeding radiation element and a grounding radiation element, wherein the feeding radiation element has at least a first open slot; a first meandering connection line; and a first cascade radiation element, coupled through the first meandering connection line to the feeding radiation element.

BRIEF DESCRIPTION OF DRAWINGS

The invention can be more fully understood by reading the subsequent detailed description and examples with references made to the accompanying drawings, wherein.

DESCRIPTION OF THE INVENTION

In order to illustrate the purposes, features and advantages of the invention, the embodiments and figures of the invention are shown in detail as follows.

Figure 1:
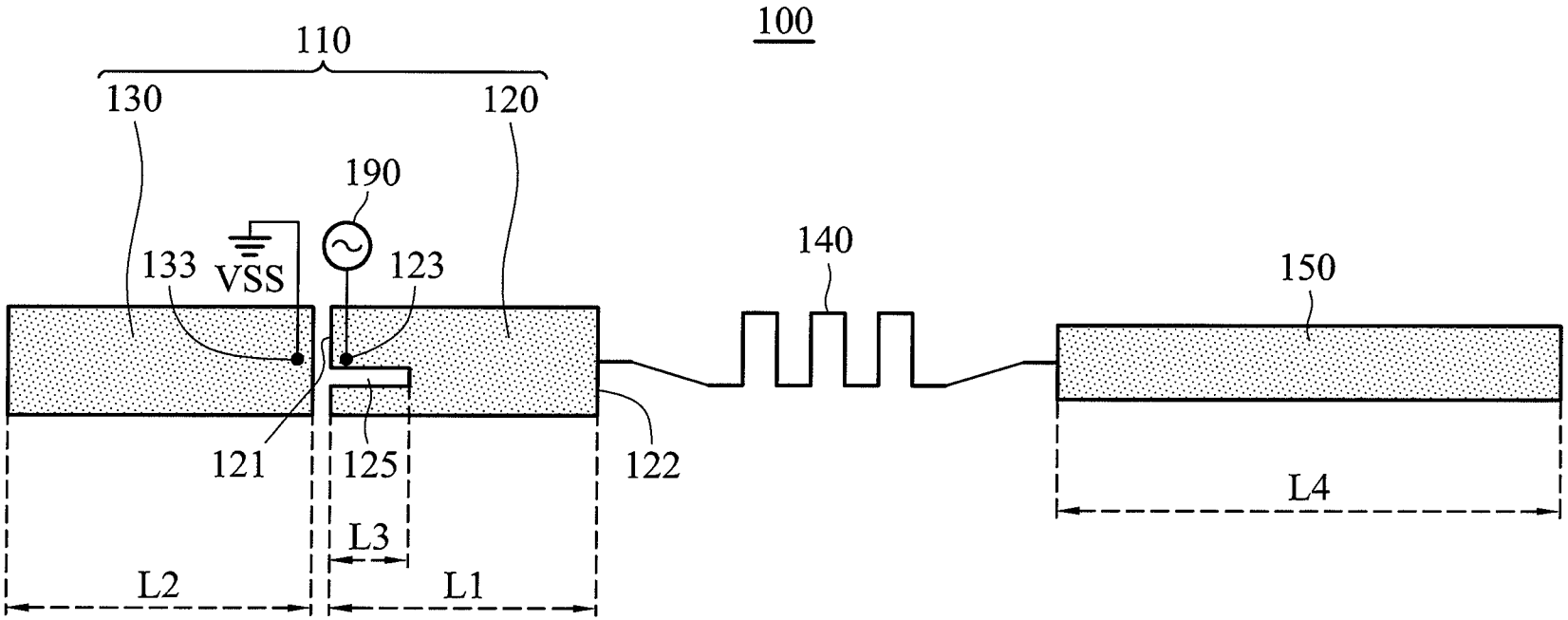
FIG. 1 shows a diagram of an antenna structure according to an embodiment of the invention.

FIG. 1 shows a diagram of an antenna structure 100 according to an embodiment of the invention. The antenna structure 100 may be made of metal, and may be disposed on a dielectric substrate, such as a PCB (Printed Circuit Board). As shown in FIG. 1, the antenna structure 100 at least includes a dipole antenna element 110, a first meandering connection line 140, and a first cascade radiation element 150. The dipole antenna element 110 includes a feeding radiation element 120 and a grounding radiation element 130. The feeding radiation element 120 has at least a first open slot 125. The first cascade radiation element 150 is coupled through the first meandering connection line 140 to the feeding radiation element 120.

More particularly, the feeding radiation element 120 has a first edge 121 and a second edge 122 that are opposite to each other. An open end of the first open slot 125 is positioned at the first edge 121 of the feeding radiation element 120, and the first meandering connection line 140 is coupled to the second edge 122 of the feeding radiation element 120. A feeding point 123 on the feeding radiation element 120 is coupled to a signal source 190. The feeding point 123 is adjacent to the open end of the first open slot 125. The signal source 190 may be an RF (Radio Frequency) module for exciting the antenna structure 100. A grounding point 133 on the grounding radiation element 130 is coupled to a ground voltage VSS (e.g., 0V).

With such a design, it may be considered that the antenna structure 100 includes an antenna array formed by the dipole antenna element 110, the first meandering connection line 140, and the first cascade radiation element 150. The dipole antenna element 110 may be configured as a main radiator of the antenna array. The first meandering connection line 140 may generate negative-phase radiation, and the first cascade radiation element 150 may generate positive-phase radiation. Since the first meandering connection line 140 has a dense and tortuous current path, any two adjacent segments of the first meandering connection line 140 have surface currents in opposite directions. As a result, from a far reference point, the aforementioned negative-phase radiation can be almost completely eliminated. On the other hand, the positive-phase radiation of the first cascade radiation element 150 can constructively interfere with the radiation of the dipole antenna element 110, such that the total gain of the antenna array can be enhanced. In other embodiments, the antenna array includes more meandering connection lines and more cascade radiation elements, and it is not limited to the configuration of FIG. 1. However, it should be understood that the antenna array is formed by cascading one or more cascade radiation elements, and in this case, the antenna array tends to generate multi-order resonant modes, resulting in the problem of poor impedance matching. Concerning this drawback, the invention further incorporates the design of at least one first open slot 125 into the feeding radiation element 120 of the dipole antenna element 110. According to some measurement results, such a design can effectively suppress the generation of multi-order resonant modes of the antenna array and therefore improve the whole impedance matching of the antenna array. Accordingly, the antenna structure of the invention has the advantages of both high antenna gain and good impedance matching, and it is suitable for application in a variety of communication devices in the wireless communication field.

In some embodiments, the shapes of the above elements are described as follows. Each of the feeding radiation element 120 and the grounding radiation element 130 may substantially have a rectangular shape. The first open slot 125 may substantially have a straight-line shape. The first meandering connection line 140 may substantially have a combination of one or more W-shapes. The first cascade radiation element 150 may substantially have a rectangular shape.

In some embodiments, the sizes of the above elements are described as follows. The length L1 of the feeding radiation element 120 and the length L2 of the grounding radiation element 130 may be both substantially equal to ¼ wavelength (λ/4) of a central operation frequency of the antenna structure 100. The length L3 of the first open slot 125 may be substantially equal to 1/12 wavelength (λ/12) of the central operation frequency of the antenna structure 100. The length of the first meandering connection line 140 (i.e., the total length of the straightened first meandering connection line 140) may be substantially equal to ½ wavelength (λ/2) of the central operation frequency of the antenna structure 100. The length L4 of the first cascade radiation element 150 may be substantially equal to ½ wavelength (λ/2) of the central operation frequency of the antenna structure 100.

Figure 2:
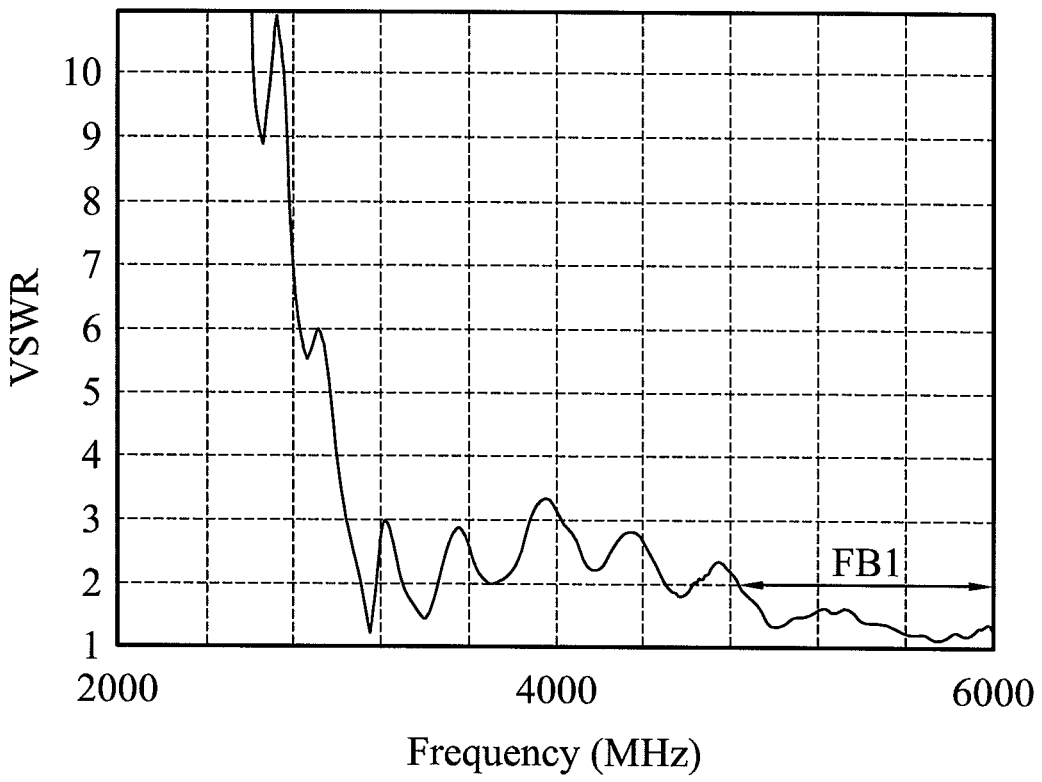
FIG. 2 shows a diagram of a VSWR (Voltage Standing Wave Ratio) of an antenna structure according to an embodiment of the invention.

FIG. 2 shows a diagram of a VSWR (Voltage Standing Wave Ratio) of the antenna structure 100 according to an embodiment of the invention. The horizontal axis represents the operation frequency (MHz), and the vertical axis represents the VSWR. According to the measurement result of FIG. 2, the antenna structure 100 can be excited to generate at least one operation frequency band FB1 which is from about 5150 MHz to about 5850 MHz. Therefore, the antenna structure 100 of the invention can cover at least the Wi-Fi 5 GHz frequency band and provide sufficient antenna gain in the aforementioned frequency band.

Figure 3:
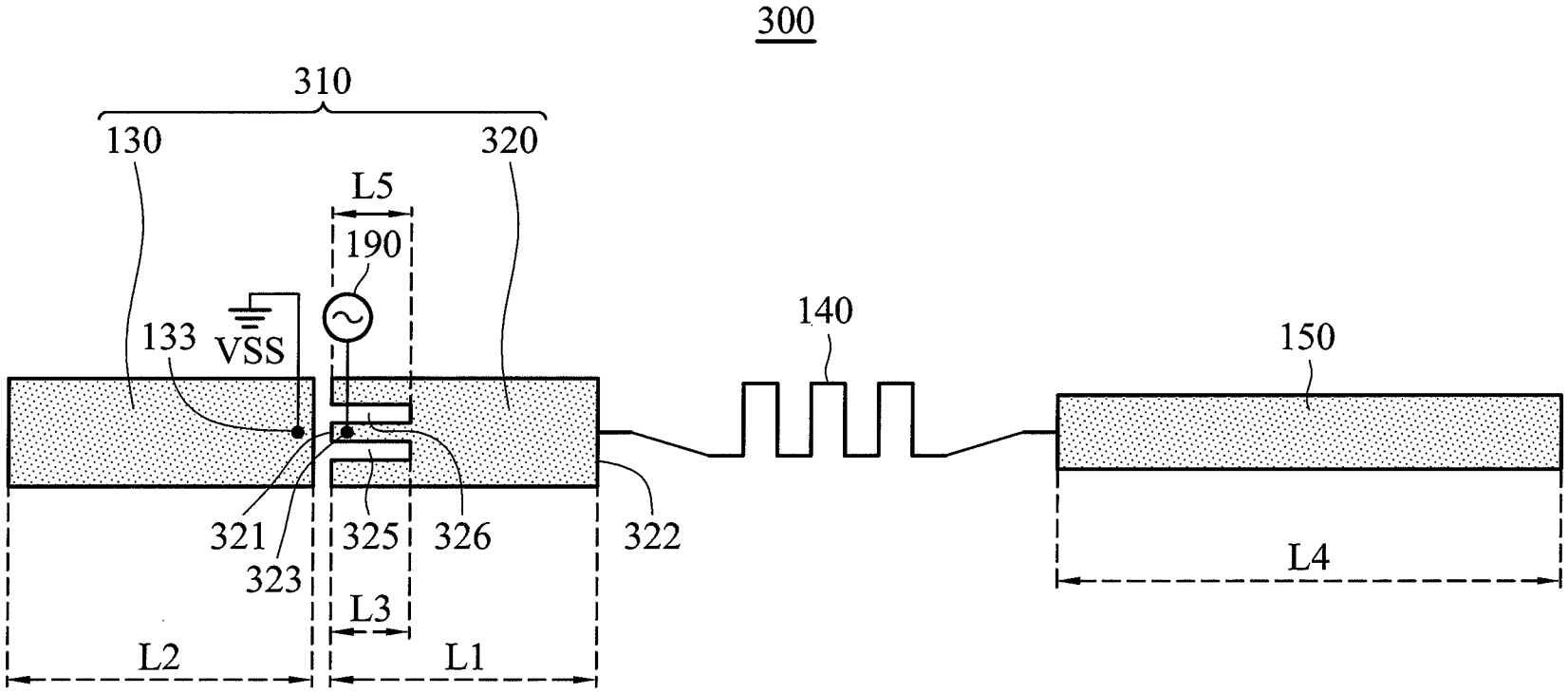
FIG. 3 shows a diagram of an antenna structure according to an embodiment of the invention.

FIG. 3 shows a diagram of an antenna structure 300 according to an embodiment of the invention. In the embodiment of FIG. 3, a feeding radiation element 320 of a dipole antenna element 310 of the antenna structure 300 has a first open slot 325 and a second open slot 326. The second open slot 326 is substantially parallel to the first open slot 325. The length L5 of the second open slot 326 is substantially equal to the length L3 of the first open slot 325. An open end of the first open slot 325 and an open end of the second open slot 326 are both positioned at a first edge 321 of the feeding radiation element 320, and the first meandering connection line 140 is coupled to a second edge 322 of the feeding radiation element 320. A feeding point 323 on the feeding radiation element 320 is coupled to a signal source 190. The feeding point 323 is adjacent to the first open slot 325 and the second open slot 326. The feeding point 323 is substantially positioned between the open end of the first open slot 325 and the open end of the second open slot 326. According to some measurement results, the two open slots of the dipole antenna element 310 can also suppress the generation of multi-order resonant modes and therefore improve the whole impedance matching of the antenna structure 300. Other features of the antenna structure 300 of FIG. 3 are similar to those of the antenna structure 100 of FIG. 1. Accordingly, the two embodiments can achieve similar levels of performance.

Figure 4:
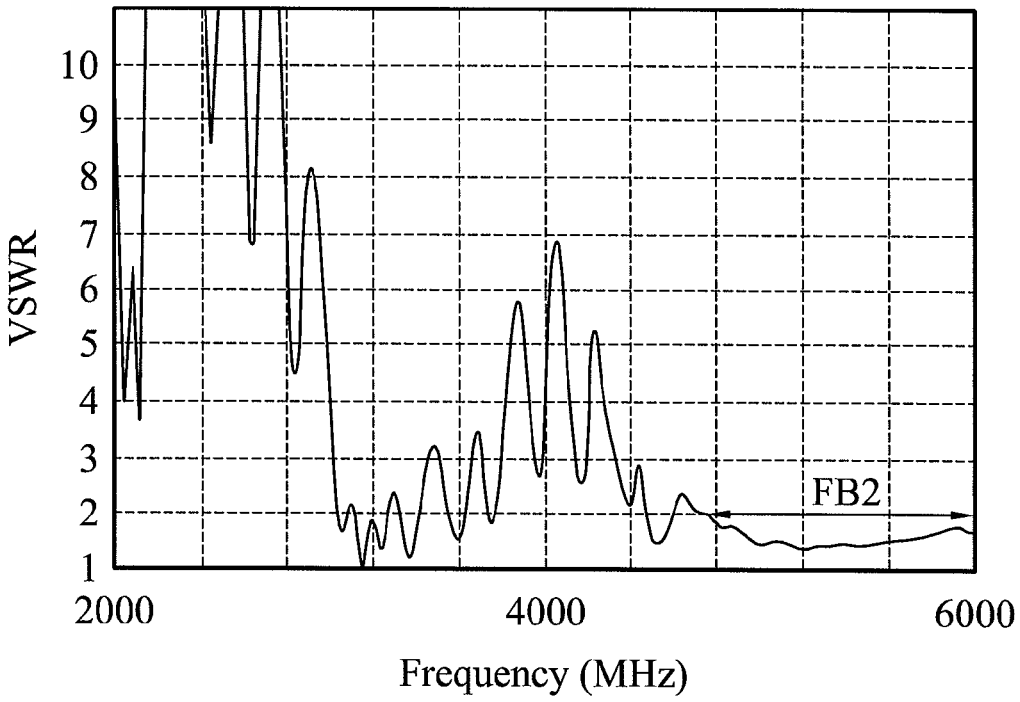
FIG. 4 shows a diagram of a VSWR of an antenna structure according to an embodiment of the invention.

FIG. 4 shows a diagram of a VSWR of the antenna structure 300 according to an embodiment of the invention. The horizontal axis represents the operation frequency (MHz), and the vertical axis represents the VSWR. According to the measurement result of FIG. 4, the antenna structure 300 can be excited to generate at least one operation frequency band FB2 which is from about 5150 MHz to about 5850 MHz. Therefore, the antenna structure 300 of the invention can cover at least the Wi-Fi 5 GHz frequency band and provide sufficient antenna gain in the aforementioned frequency band.

Figure 5:
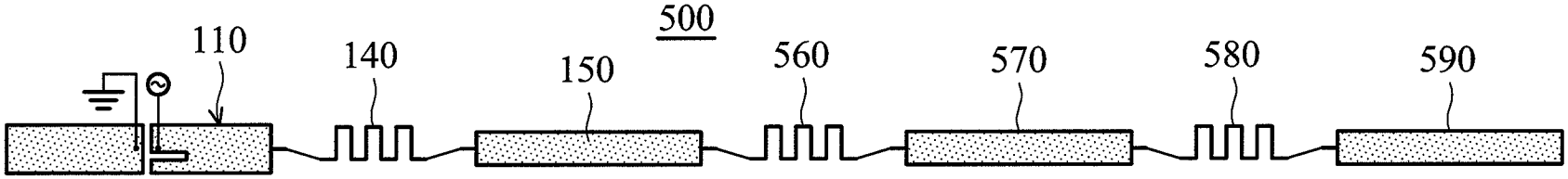
FIG. 5 shows a diagram of an antenna structure according to an embodiment of the invention.

FIG. 5 shows a diagram of an antenna structure 500 according to an embodiment of the invention. In the embodiment of FIG. 5, the antenna structure 500 includes a dipole antenna element 110, a first meandering connection line 140, a first cascade radiation element 150, a second meandering connection line 560, a second cascade radiation element 570, a third meandering connection line 580, and a third cascade radiation element 590. Each of the second meandering connection line 560 and the third meandering connection line 580 has the same structure as the first meandering connection line 140 as described in the embodiment of FIG. 1. Each of the second cascade radiation element 570 and the third cascade radiation element 590 has the same structure as the first cascade radiation element 150 as described in the embodiment of FIG. 1. The second cascade radiation element 570 is coupled through the second meandering connection line 560 to the first cascade radiation element 150. The third cascade radiation element 590 is coupled through the third meandering connection line 580 to the second cascade radiation element 570. It is understood that although FIG. 5 displays the antenna structure 500 merely including two additional meandering connection lines and two additional cascade radiation elements, adjustments may be made such that the antenna structure 500 includes more or fewer meandering connection lines and cascade radiation elements in other embodiments. For example, the antenna structure 500 may include 1, 2, 3, 4, 5, or 6 additional meandering connection lines, and 1, 2, 3, 4, 5, or 6 additional cascade radiation elements. The added cascade radiation elements can further enhance the antenna gain of the antenna structure 500. According to some measurement results, the total gain of the antenna structure 500 reaches 5 dBi to 9 dBi after additional cascade radiation elements are included. The aforementioned antenna gain meets the requirements of applications of general high-gain antennas. Other features of the antenna structure 500 of FIG. 5 are similar to those of the antenna structure 100 of FIG. 1. Accordingly, the two embodiments can achieve similar levels of performance.

Figure 6:
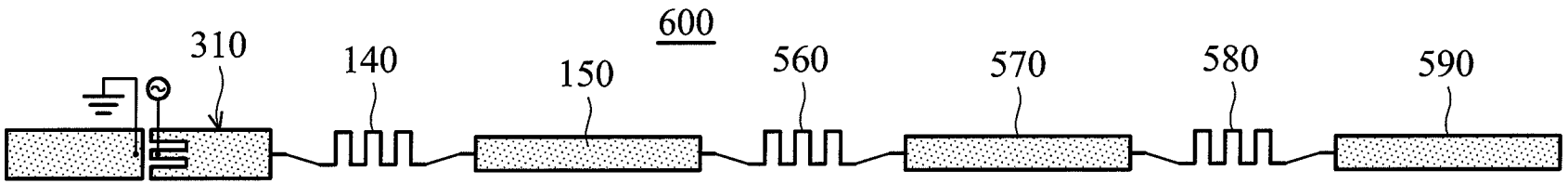
FIG. 6 shows a diagram of an antenna structure according to an embodiment of the invention.

FIG. 6 shows a diagram of an antenna structure 600 according to an embodiment of the invention. In the embodiment of FIG. 6, the antenna structure 600 includes a dipole antenna element 310, a first meandering connection line 140, a first cascade radiation element 150, a second meandering connection line 560, a second cascade radiation element 570, a third meandering connection line 580, and a third cascade radiation element 590. Each of the second meandering connection line 560 and the third meandering connection line 580 has the same structure as the first meandering connection line 140 as described in the embodiment of FIG. 3. Each of the second cascade radiation element 570 and the third cascade radiation element 590 has the same structure as the first cascade radiation element 150 as described in the embodiment of FIG. 3. The second cascade radiation element 570 is coupled through the second meandering connection line 560 to the first cascade radiation element 150. The third cascade radiation element 590 is coupled through the third meandering connection line 580 to the second cascade radiation element 570. It is understood that although FIG. 6 displays the antenna structure 600 merely including two additional meandering connection lines and two additional cascade radiation elements, adjustments may be made such that the antenna structure 600 includes more or fewer meandering connection lines and cascade radiation elements in other embodiments. For example, the antenna structure 600 may include 1, 2, 3, 4, 5, or 6 additional meandering connection lines, and 1, 2, 3, 4, 5, or 6 additional cascade radiation elements. The added cascade radiation elements can further enhance the antenna gain of the antenna structure 600. According to some measurement results, the total gain of the antenna structure 600 reaches 5 dBi to 9 dBi after additional cascade radiation elements are included. The aforementioned antenna gain meets the requirements of applications of general high-gain antennas. Other features of the antenna structure 600 of FIG. 6 are similar to those of the antenna structure 300 of FIG. 3. Accordingly, the two embodiments can achieve similar levels of performance.

Note that the above element sizes, element parameters, element shapes, and frequency ranges are not limitations of the invention. An antenna engineer can adjust these settings or values according to different requirements. It is understood that the antenna structure of the invention is not limited to the configurations of FIGS. 1-6. The invention may merely include any one or more features of any one or more embodiments of FIGS. 1-6. In other words, not all of the features shown in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a dipole antenna element, comprising a feeding radiation element and a grounding radiation element, wherein the feeding radiation element has at least a first open slot;

a first meandering connection line; and a first cascade radiation element, coupled through the first meandering connection line to the feeding radiation element, wherein the dipole antenna element, the first meandering connection line, and the first cascade radiation element are planar on a dielectric substrate;

wherein the feeding radiation element further has a second open slot;

wherein each of the first open slot and the second open slot has an open end and a closed end.

2. The antenna structure as claimed in claim 1, wherein a feeding point on the feeding radiation element is coupled to a signal source, and a grounding point on the grounding radiation element is coupled to a ground voltage.

3. The antenna structure as claimed in claim 2, wherein the feeding point is positioned between the open end of the first open slot and the open end of the second open slot.

4. The antenna structure as claimed in claim 3, wherein the open end of the first open slot is positioned at a first edge of the feeding radiation element, the first meandering connection line is coupled to a second edge of the feeding radiation element, and the first edge is opposite to the second edge.

5. The antenna structure as claimed in claim 1, wherein each of the feeding radiation element and the grounding radiation element substantially has a rectangular shape.

6. The antenna structure as claimed in claim 1, wherein the first open slot substantially has a straight-line shape.

7. The antenna structure as claimed in claim 1, wherein the first meandering connection line substantially has a combination of one or more W-shapes.

8. The antenna structure as claimed in claim 1, wherein the first cascade radiation element substantially has a rectangular shape.

9. The antenna structure as claimed in claim 1, wherein a length of each of the feeding radiation element and the grounding radiation element is substantially equal to ¼ wavelength of a central operation frequency of the antenna structure.

10. The antenna structure as claimed in claim 1, wherein a length of the first open slot is equal to 1/12 wavelength of a central operation frequency of the antenna structure.

11. The antenna structure as claimed in claim 1, wherein a length of the first meandering connection line is substantially equal to ½ wavelength of a central operation frequency of the antenna structure.

12. The antenna structure as claimed in claim 1, wherein a length of the first cascade radiation element is substantially equal to ½ wavelength of a central operation frequency of the antenna structure.

13. The antenna structure as claimed in claim 1, wherein the second open slot is substantially parallel to the first open slot.

14. The antenna structure as claimed in claim 1, wherein a length of the second open slot is substantially equal to a length of the first open slot.

15. The antenna structure as claimed in claim 1, wherein a feeding point on the feeding radiation element is coupled to a signal source, and a grounding point on the grounding radiation element is coupled to a ground voltage.

16. The antenna structure as claimed in claim 15, wherein the feeding point is adjacent to the first open slot and the second open slot, and the feeding point is substantially positioned between an open end of the first open slot and an open end of the second open slot.

17. The antenna structure as claimed in claim 16, wherein the open end of the first open slot and the open end of the second open slot are positioned at a first edge of the feeding radiation element, the first meandering connection line is coupled to a second edge of the feeding radiation element, and the first edge is opposite to the second edge.

18. The antenna structure as claimed in claim 1, further comprising:

a second meandering connection line; and a second cascade radiation element, coupled through the second meandering connection line to the first cascade radiation element.

19. The antenna structure as claimed in claim 18, further comprising:

a third meandering connection line; and a third cascade radiation element, coupled through the third meandering connection line to the second cascade radiation element.

* * * * *